United States Patent [19]

Sodemann

[11] Patent Number: 4,924,610

[45] Date of Patent: May 15, 1990

[54] APPARATUS FOR ROADWAY SNOW PLOW ATTACHMENT

[76] Inventor: Wayne N. Sodemann, 3981 Lake Dr., West Bend, Wis. 53095

[21] Appl. No.: 355,293

[22] Filed: May 22, 1989

[51] Int. Cl.[5] ..... E01H 5/06

[52] U.S. Cl. ..... 37/231; 37/266; 37/279; 37/283

[58] Field of Search ..... 37/231, 235, 266, 279, 37/283, 108 R, 117.5, 115, 116, DIG. 12

[56] References Cited

U.S. PATENT DOCUMENTS

| | | | |
|---|---|---|---|
| 1,709,244 | 4/1929 | Abbe | 37/235 X |
| 1,803,754 | 5/1931 | Frink | 37/231 |
| 2,430,221 | 11/1947 | Frink | 37/231 |
| 2,776,767 | 1/1957 | Stover | 37/231 X |
| 4,254,564 | 3/1981 | Rath | 37/283 X |
| 4,369,590 | 1/1983 | Miller | 37/231 |
| 4,813,164 | 3/1989 | Morrell | 37/117.5 |
| 4,821,435 | 4/1989 | Pester | 37/231 |
| 4,821,436 | 4/1989 | Slocum | 37/235 |

*Primary Examiner*—Randolph A. Reese
*Assistant Examiner*—J. Russell McBee
*Attorney, Agent, or Firm*—Robert T. Johnson

[57] ABSTRACT

This invention is to disclose and claim apparatus for a roadway snow plow attachment described as a cable mount disc or pulley mounted in a cable holder disc or pulley housing and a cable hanger yoke vertically hanging and attached to a hanger arm and a cable threaded on one loop around the cable mount disc or pulley and the eyes of the cable attached to the snow plow blade mount beam and the cable eyes attached to the plow blade mount beam at points or locations extending outwardly from the vertical center line of the snow plow blade.

4 Claims, 3 Drawing Sheets

APPARATUS FOR ROADWAY SNOW PLOW ATTACHMENT

EXPLANATION OF INVENTION

The conventional method for mounting of a roadway snow plow onto a truck has been to attach the plow blade to apparatus extending out from the front of the truck and to use a chain for support of the apparatus.

The chain is vertically mounted, one end of which is attached to a cylinder raising arm and the other end, bottom end, is attached to the snow plow blade apparatus.

This present invention is to disclose a cable to replace the chain, and the cable to be threaded through a cable holder disc or pulley housing and wrapped once around a cable mounting disc or pulley and the ends of the cable attached to the snow plow blade apparatus or blade mount beam.

The advantage of this cable mount of the plow blade and apparatus is that the blade is held at any suspended tilt angle and the tilt angle can be changed merely by dropping the blade to the road surface at which time the cable adjusts the movement around the disc or pulley movement to support the plow apparatus at a level or other desired tilt.

The cable adjustment, by slippage around the cable pulley holder disc, or by pulley movement, takes place due to slack on one side or end of the cable which then allows the loop to slip around the disc or revolve the pulley until the cable is taut. When the cable is taut, there is no slippage of the cable around the disc, or revolvement of the pulley.

This then obviates the necessity for a person to manually adjust a chain suspension as was heretofore required.

BACKGROUND ART

A snow plow blade for highway snow removal, is mounted on apparatus attached to the front of a truck. This apparatus attached to the front of a truck is well known, and the snow plow blade is mounted on the truck apparatus as noted in reference patents 1,803,754 and 2,430,221, wherein reference is made to lifting chains or cable attached to a grab hook.

OBJECTS OF THIS INVENTION

An object of this invention is to disclose apparatus described as a cable mount disc rigidly attached in a cable holder disc housing and attached to a cable hanger yoke vertically hanging and attached to a hanger arm centered over the vertical center line of the plow blade and a cable threaded in one loop, around the cable mount disc and the eyes of the cable attached to a snow plow blade mount beam and the cable eyes attached to the snow plow blade at locations outward from the vertical center line of the snow plow blade.

The cable eyes can be attached to the back of the plow on the plow blade mount beam, and at points outwardly from the vertical center of the snow plow blade as noted above.

Another object of this invention is to disclose apparatus described as a cable mount pulley mounted in a cable holder pulley housing and attached to a cable hanger yoke vertically hanging and attached to a hanger arm centered over the vertical center line of the plow blade and a cable threaded in one loop around the cable mount pulley, and the eyes of the cable attached to the snow plow blade apparatus and the cable eyes attached to the snow plow blade at locations outward from the vertical center line of the snow plow blade.

Another object of this invention is to disclose cable mount means attached in a cable mount means housing, and the cable mount means may be a rigidly attached disc in the cable mount means housing or a pulley mounted in the cable mount means housing.

Another object of this invention is to disclose a chain as an alternate to a cable on a pulley mounted in the mount means housing.

BRIEF DESCRIPTION OF DRAWINGS

FIG. 1—Side elevation view of snow plow cable hanger.

DETAILED DESCRIPTION OF DRAWINGS

Figure 1:
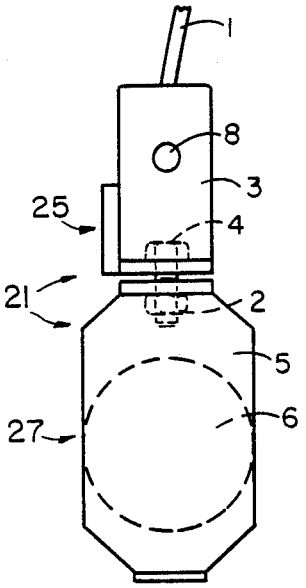
FIG. 1—Front elevation view of snow plow cable hanger.
Figure 2:
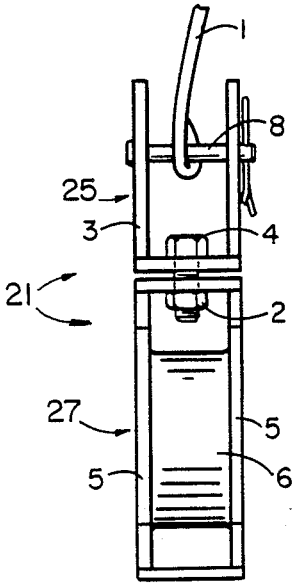
Figure 4:
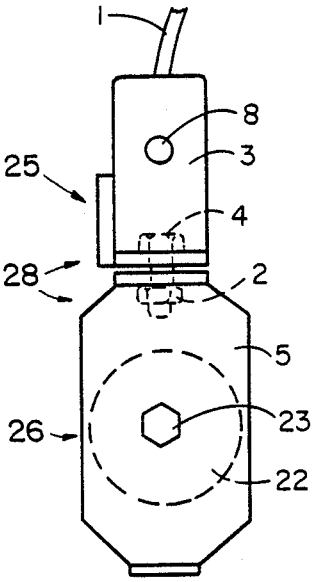
FIG. 4—Front elevation view of pulley mounted in snow plow cable hanger.
Figure 3:
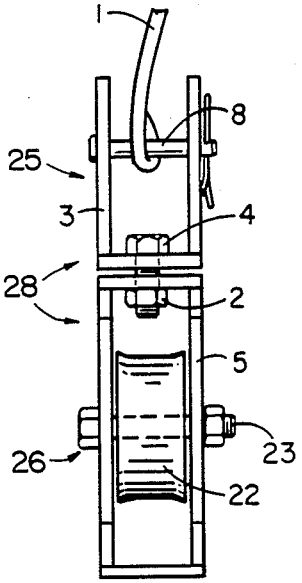
FIG. 3—Side elevation view of pulley mounted in snow plow cable hanger.
Figure 5:
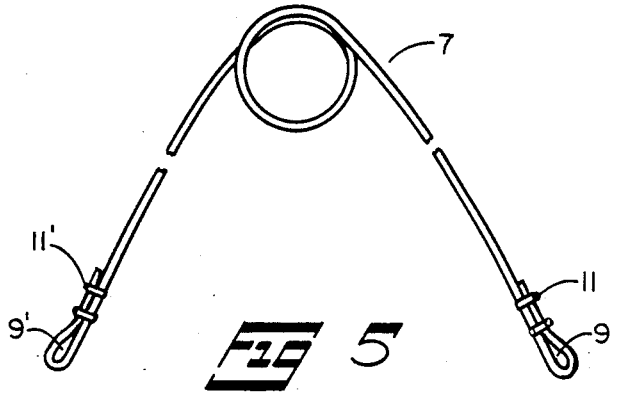
FIG. 5—Snow plow apparatus suspension cable.
Figure 7:
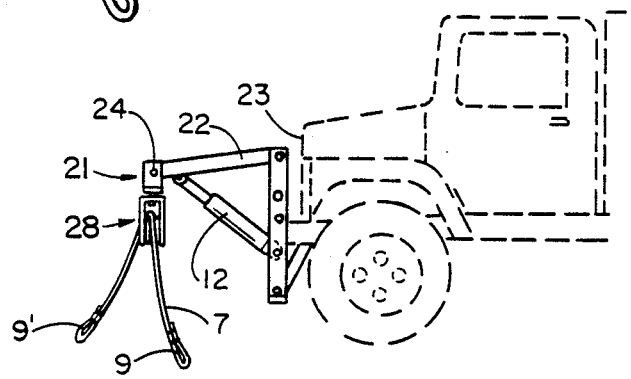
FIG. 7—Side elevation view of snow plow mount apparatus attached to a truck.
Figure 6:
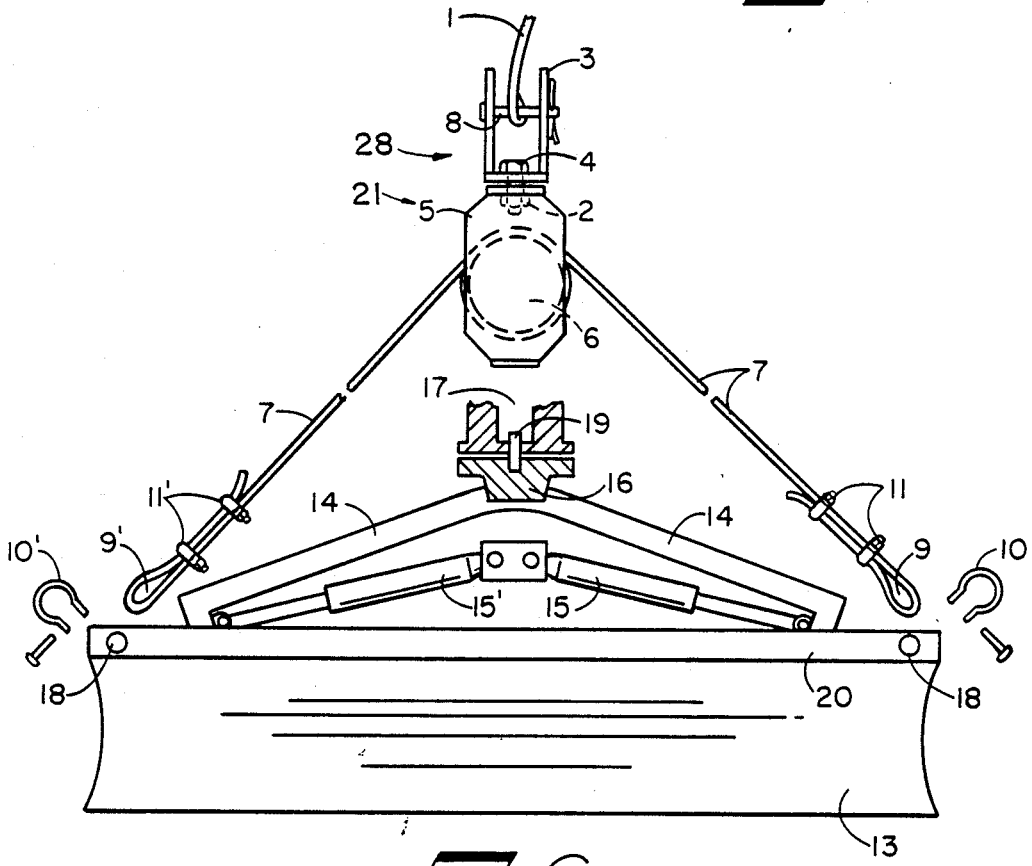
FIG. 6—Front elevation view of snow plow cable mounted in cable hanger.
Figure 8:
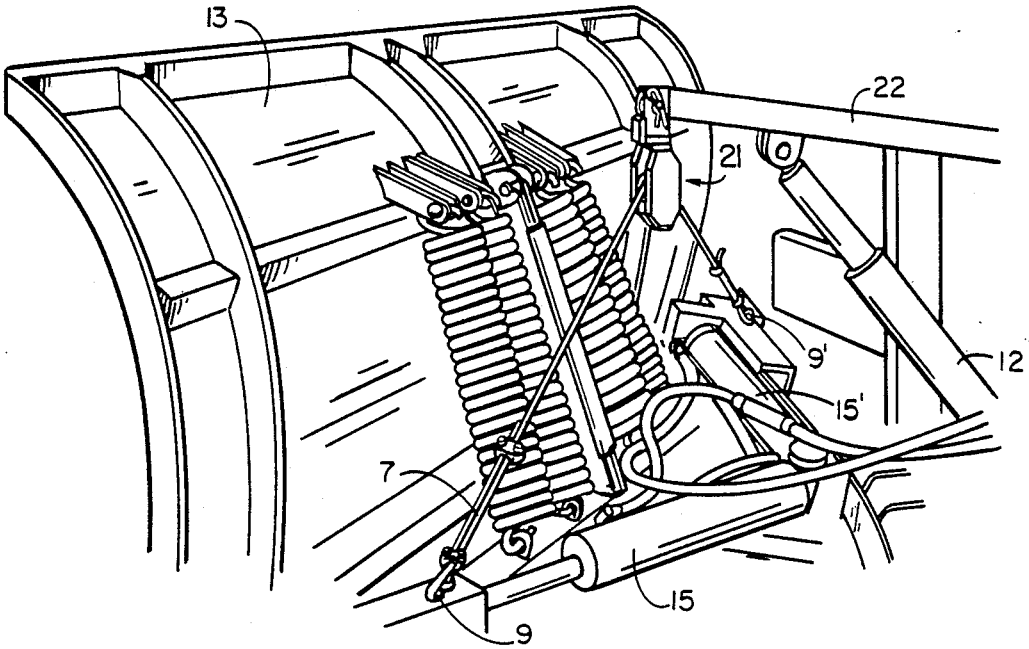
FIG. 8—Side perspective elevation view of snow plow blade and mount apparatus attached to truckfront end.
Figure 9:
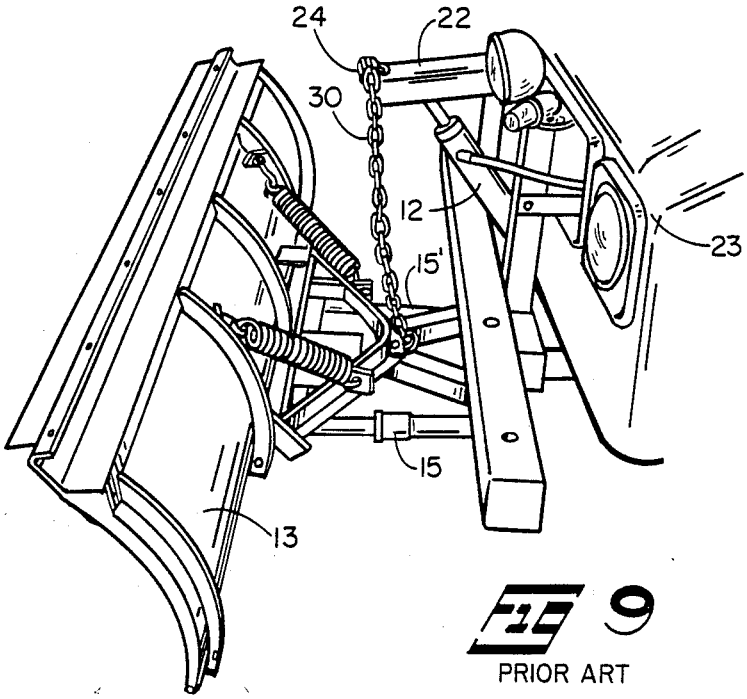
FIG 9 PRIOR ART
FIG. 9—Side perspective elevation view of snow plow and mount apparatus of conventional mounting to date showing a chain connecting the hanger arm to a single connection on the center of the snow plow mounting beam.

FIG. 1—Elevation view of snow plow cable hanger wherein:

1—Cable hanger leg mount
2—Threaded nut
3—Cable hanger yoke
4—Bolt connecting cable hanger yoke and cable holder disc
5—Cable holder disc/pulley housing
8—Pin across yoke arms
21—Assembly apparatus of cable hanger
25—Cable hanger yoke assembly
27—Cable hanger disc housing assembly FIG. 2—Side elevation view of snow plow cable hanger wherein:

1—Cable hanger leg mount
2—Threaded nut
3—Cable hanger yoke
4—Bolt connecting cable hanger yoke and cable holder disc
5—Cable holder disc/pulley housing
6—Cable mount disc
21—Assembled apparatus of cable hanger
25—Cable hanger yoke assembly
27—Cable hangr disc housing assembly FIG. 3—Side elevation view of pulley mounted in snow plow hanger wherein:

1—Cable hanger leg mount
2—Threaded nut
3—Cable hanger yoke
4—Bolt connecting cable hanger yoke and cable holder pulley assembly 5—Cable holder disc/pulley housing
8—Pin across yoke arms
31—Pulley
29—Pulley axle bolt
24—Assembled apparatus of pulley cable hanger
25—Cable hanger yoke assembly
26—Cable holder pulley housing assembly
28—Assembled apparatus of pulley cable hanger FIG. 4—Front elevation view of pulley mounted in snow plow hanger wherein:
1—Cable hanger leg mount
2—Threaded nut
3—Cable hanger yoke
4—Bolt connecting cable hanger yoke and cable holder pulley assembly
5—Cable holder disc/pulley housing
8—Pin across yoke arms
31—Pulley ghost view
23—Pulley axle bolt
24—Assembly apparatus of pulley cable hanger
25—Cable hanger yoke assembly
26—Cable holder pulley housing assembly
28—Assembled apparatus of pulley cable hanger FIG. 5—Snow plow apparatus suspension cable wherein:
7—Cable
9,9'—Cable eyes FIG. 6—Front elevation view of snow plow cable mounted in cable hanger wherein:
1—Cable hanger leg mount
2—Threaded nut
3—Cable hanger yoke
4—Bolt connecting cable hanger yoke and cable holder disc
5—Cable holder disc/pulley housing
6—Cable mounting disc/pulley (ghost view)
7—Cable threaded around cable mounting disc/pulley
8—Pin across yoke arms
9,9'—Cable eyes
10,10'—Clevis attachment from snow plow blade to cable eyes
11,11'—Cable eye clamps
13—Snow plow blade
14—Angle iron mounting beam
15,15'—Hydraulic cylinders
16—Vehicle connection support to plow mounting beam
18,18'—Mount for attachment of cable eyes
17—Connection to truck front
19—Pivot mount pin
20—Plow blade mount beam
21—Assembly apparatus of disc cable hanger
28—Assembly apparatus of pulley cable hanger FIG. 7—Side elevation view of snow plow mount apparatus attached to a truck wherein:
7—Cable
9,9'—Cable eyes
12—Hydraulic cylinder to hanger arm
21—Assembled apparatus of cables hanger
22—Hanger arm
23—Truck
24—Hanger arm end connection FIG. 8—Side perspective elevation view of snow plow blade and mount apparatus attached to truck front end wherein:
7—Cable
9,9'—Cable eyes
12—Hydraulic cylinder to hanger arm
13—Snow plow blade
15,15'—Hydraulic cylinders to adjust blade angle
21—Assembled apparatus of cable hanger
22—Hanger arm
23—Truck front
24—Hanger arm end connection FIG. 9—Side perspective elevation view of snow plow and mount apparatus of conventional mounting to date, showing a chain connecting the hanger arm to a single connection on the center of snow plow mounting beam wherein:
12—Hydraulic cylinder to hanger arm
13—Snow plow blade
15,15'—Hydraulic cylinders to adjust blade angle
22—Hanger arm
23—Truck front
24—Hanger arm end connection
30—Link chain
22—Link chain connection to center of mounting beam of plow blade

DETAILED DESCRIPTION OF INVENTION

To date, highway snow plow blades suspended by a chain have had problems and disadvantages, some of which are the tilt of the snow plow blade has to be adjusted by manual operation to rehang the chain. Another problem encountered is the chain slipping through the mounting hook slot.

This present invention obviates the above disadvantages, the explanation of which follows.

The highway snow plow blade mounting apparatus of this invention is to be described as a cable mount disc 6 rigidly attached in a cable holder disc housing 5 pivotally attached to cable hanger yoke 3 vertically hanging and attached to a hanger arm 22 and a cable 7 threaded in one loop around the cable mount disc 6 and the eyes 9 and 9' of cable 7 threaded in one loop around the disc 6 and attached to the snow plow blade mount beam 20 and the cable eyes 9,9' attached to the plow blade mount beam 20 at points outwardly from the vertical center of the snow plow blade 13, and further the points outwardly are defined as loci of one eye to the left and one eye to the right of the vertical center line of the plow blade 13.

The cable eyes 9 and 9' are conventional as shown and held with cable eye clamps 11 and 11'.

The conventional components of snow plow mount are shown which are hydraulic cylinder 12 to hanger arm 22, and hydraulic cylinders 15 and 15' to adjust the angle of the snow plow blade 13. The angle iron mounting beam 14 fits in truck connection support to plow mounting beam 16.

As an alternate to the disc 6 rigidly attached to the interior of the cable holder disc housing, a pulley 22 is mounted on bolt axle 23 and the cable 7 is threaded over and once around the pulley, same as the threaded cable around the disc 6.

The attachment of the cable 7 to the snow plow blade apparatus is the same whether the disc 6 mount or the pulley 31 is used in the apparatus, and in view of this, FIGS. 6 and 7 show 21 and 28 as alternate apparatus mounting.

As explained above regarding the slippage of the cable 7 around the disc 6, however, when a pulley 31 is mounted in the housing 5, when the cable is slack on one side the pulley 31 revolves until the cable is taut to then hold the snow plow blade in position for plowing.

In explaining the operation of this apparatus with the disc 6 in the apparatus, the pulley 22 apparatus performs in the same manner except the pulley revolves to balance the tautness of the cable 7 instead of slippage of the cable 7 as is noted with the disc 6.

The cable hanger yoke assembly 25 remains the same whether the disc 6 or pulley 22 is used.

The cable holder pulley housing assembly 26 pivots on hanger bolt 4 with nut 2, same as housing assembly 27 with disc 6.

To insure clarity of this invention, the FIGS. 1–4 show the cable attachments apparatus for snow plow blade attachments of this invention.

FIG. 9 shows the conventional vertical link chain 30, for vertical support and movement of the plow blade 13 in contrast to this invention disclosure.

The assembly apparatus of cable hanger 21 and 28 is shown in FIGS. 1, 2, 3, 4, 6, 7 wherein cable hanger leg mount 1 attaches to hanger arm 22 and is vertically attached to cable hanger yoke 3 by means of a suitable pin across the yoke arms 8.

The yoke 3 is pivotally attached to cable holder disc or pulley housing 5 by means of a bolt 4 connecting cable hanger yoke 3 and cable holder disc or pulley housing, and a threaded nut 2 screwed on to the bolt 4.

Cable mount disc 6 is rigidly attached, as by welding, to the interior of cable holder disc housing 5, and cable 7 threaded once around cable mounting disc 6. The cable eyes 9 and 9' are attached to snow plow blade back beam 20 is to be outwardly from the center of the snow plow blade and as shown in FIG. 4, the attachments of the cable eyes 9 and 9' to straddle the vertical center line of the plow blade and extend outwardly to the ends of the plow back beam 20 and are shown as at 18,18' mounts for attachment of the cable eyes 19,19'.

The connection 17 to the truck front 23 is shown, in part, along with pivot mount pin 19.

The mount for the snow plow is shown in FIG. 7 wherein the truck 23 and hanger arm end connection 24 is seen in relation to the cable 7 and assembled apparatus of the cable hanger 21.

To further explain or describe this invention, the cable 7 can slip back and forth around the cable mounting disc, but such slippage occurs only when one side of the snow plow blade is raised as by dropping the blade on a slanted roadway at which time the cable is slack on the side which first makes contact with the high side of the roadway, and due to such slack the cable 7 slips around the cable mount disc 6 allowing the opposite or high side of the plow blade to lower to the roadway surface.

When the cable is taut on both sides, the snow plow blade 13 can be raised or lowered by actuation of hydraulic cylinder to hanger arm 12.

When the cable is taut on both sides of the assembled apparatus of cable hanger 21, there is no slippage of the cable 7 around cable mount disc 6, and the snow plow blade 13 can be raised or lowered by actuation of hydraulic cylinder to hanger arm 12.

As stated above, the cable eyes 9,9' are attached to the snow plow blade 13, at points outwards from and to straddle the vertical center line of the snow plow blade 13. The FIGS. 6 and 8 shows the cable eyes 9 and 9' for attachment at 18,18' on the plow blade mount beam 20, however attachments of the cable eyes can be on the other reinforcement locations or straps on the back of the snow plow blade.

In this invention disclosure the word "cable" is to be defined as a wire rope. Further, this could include conventional rope as an alternate, but cable is preferred in this invention.

As an alternate to the cable 7, chain can be mounted in a loop around the pulley 22 or rigidly mounted disc 6, but cable is preferred over a chain.

A lubricant can be applied to the cable loop to facilitate slippage around the cable mount disc.

Threaded in "one loop", or a "loop", is to be defined as overlapped at the top of the disc or pulley, as noted in FIG. 5.

A chain, as described, is adequate disclosure and thus is not shown in the drawings.

Having described my invention, I claim:

1. As an article of manufacture apparatus for roadway snow plow attachment wherein the improvement comprises:

a. cable mount means attached in a cable mount means housing and
b. a cable hanger yoke vertically and pivotally attached to said cable mount means housing and
c. said cable hanger yoke vertically hanging and attached to a hanger arm and
d. a cable threaded in one loop around a cable mount disc, said cable having a plurality of eyes, and
e. the eyes of said cable threaded on one loop around said disc and attached to a snow plow blade mount beam and
f. said eyes of said cable attached to said plow blade mount beam at points outwardly from the vertical center line of said snow plow blade mount beam.

2. Apparatus for roadway snow plow attachment wherein the improvement comprises:

a. a cable mount disc rigidly attached in a cable disc housing and
b. a cable hanger yoke vertically and pivotally attached to a cable holder disc housing and
c. said cable hanger yoke vertically hanging and attached to a hanger arm and
d. a cable threaded in one loop around said disc, said cable having a plurality of eyes, and
e. the eyes of said cable threaded in one loop around said disc attached to a snow plow blade mount beam at points outwardly from the vertical center line of said snow plow blade mount beam.

3. Apparatus for roadway snow plow attachment wherein the improvement comprises:

a. a snow plow blade apparatus attached to a truck and
b. a mount pulley attached on an axle in a pulley housing and
c. a hanger yoke vertically and pivotally attached to a cable holder pulley housing and
d. said hanger yoke vertically hanging and attached to a hanger arm and
e. a cable threaded in one loop around said pulley, said cable having a plurality of eyes, and
f. the eyes of said cable threaded in one loop around said pulley and attached to a snow plow blade beam and
g. said cable eyes attached to a plow blade mount beam at locations outwardly from the vertical center line of said snow plow blade mount beam.

4. Apparatus for roadway snow plow attachment wherein the improvement comprises:

a. a snow plow blade apparatus attached to a truck and b. a pulley attached on an axle in a pulley housing and
c. a hanger yoke vertically and pivotally attached to said pulley housing and
d. said hanger yoke vertically hanging and attached to a hanger arm and
e. a chain threaded in one loop around said pulley mounted on said axle in assembly apparatus of said pulley housing and
f. the ends of said chain attached to the back of a snow plow blade at points outwardly from the vertical center line of said snow plow blade.

* * * * *